US009086716B2

(12) United States Patent
Buiatti

(10) Patent No.: US 9,086,716 B2
(45) Date of Patent: Jul. 21, 2015

(54) METHOD FOR OBTAINING INFORMATION ENABLING THE DETERMINATION OF A CHARACTERISTIC OF A POWER SOURCE

(75) Inventor: Gustavo Buiatti, Rennes Cedex (FR)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 147 days.

(21) Appl. No.: 13/513,779

(22) PCT Filed: Dec. 8, 2010

(86) PCT No.: PCT/EP2010/069212
§ 371 (c)(1),
(2), (4) Date: Jun. 4, 2012

(87) PCT Pub. No.: WO2011/073070
PCT Pub. Date: Jun. 23, 2011

(65) Prior Publication Data

US 2012/0235665 A1 Sep. 20, 2012

(30) Foreign Application Priority Data

Dec. 14, 2009 (EP) ..... 09179088

(51) Int. Cl.
*G05F 5/00* (2006.01)
*G05F 1/00* (2006.01)
*G05F 1/67* (2006.01)

(52) U.S. Cl.
CPC ..... *G05F 1/67* (2013.01)

(58) Field of Classification Search
USPC ..... 323/217, 222, 223, 246, 259, 268, 271, 323/285, 299, 300, 325, 351, 906
See application file for complete search history.

(56) References Cited

U.S. PATENT DOCUMENTS

| | | | | |
|---|---|---|---|---|
| 5,350,997 | A * | 9/1994 | Ghotbi et al. | 323/268 |
| 5,808,455 | A * | 9/1998 | Schwartz et al. | 323/271 |
| 5,869,956 | A | 2/1999 | Nagao et al. | |
| 6,111,767 | A | 8/2000 | Handleman | |
| 6,339,538 | B1 | 1/2002 | Handleman | |
| 2003/0142519 | A1 * | 7/2003 | Walters et al. | 363/89 |
| 2004/0182696 | A1 * | 9/2004 | Kuriyama et al. | 323/371 |
| 2006/0132102 | A1 * | 6/2006 | Harvey | 320/166 |
| 2007/0052395 | A1 * | 3/2007 | Belch | 323/222 |
| 2008/0143188 | A1 * | 6/2008 | Adest et al. | 307/82 |
| 2009/0015229 | A1 * | 1/2009 | Kotikalapoodi | 323/285 |
| 2009/0284240 | A1 | 11/2009 | Zhang et al. | |
| 2009/0289594 | A1 | 11/2009 | Sato | |
| 2012/0139504 | A1 | 6/2012 | Buiatti | |

FOREIGN PATENT DOCUMENTS

EP 2 056 180 5/2009

OTHER PUBLICATIONS

Hua, C., et al., "Comparative Study of Peak Power Tracking Techniques for Solar Storage System," Applied Power Electronics Conference and Exposition, vol. 2, pp. 679-685, (Feb. 15, 1998).
International Search Report Issued Mar. 11, 2011 in PCT/EP10/69212 Filed Dec. 8, 2010.
U.S. Appl. No. 13/515,523, filed Jun. 13, 2012, Buiatti.

* cited by examiner

*Primary Examiner* — Adolf Berhane
*Assistant Examiner* — Alex Torres-Rivera
(74) *Attorney, Agent, or Firm* — Oblon, McClelland, Maier & Neustadt, L.L.P.

(57) ABSTRACT

The present invention concerns an apparatus for obtaining information enabling the determination of a characteristic like the maximum power point of a power source, characterized in that the apparatus for obtaining information enabling the determination of the characteristic of the power source comprises means for monitoring the voltage on an inductor linked to the power source in order to obtain information enabling the determination of the characteristic of the power source.

13 Claims, 10 Drawing Sheets

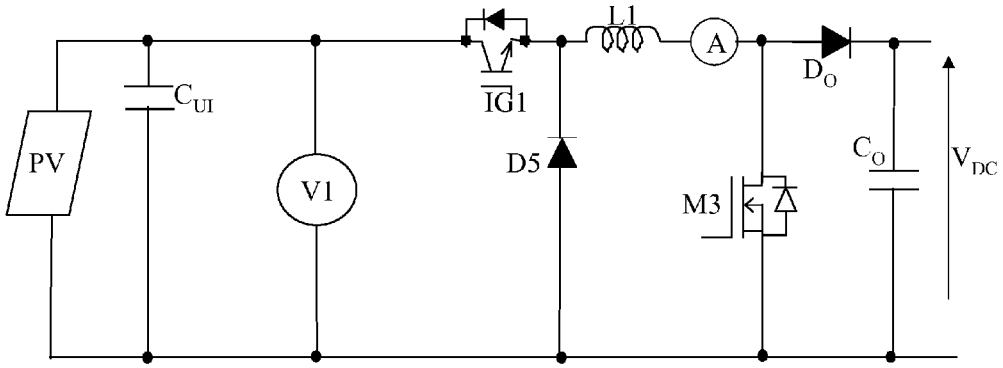
Fig. 9
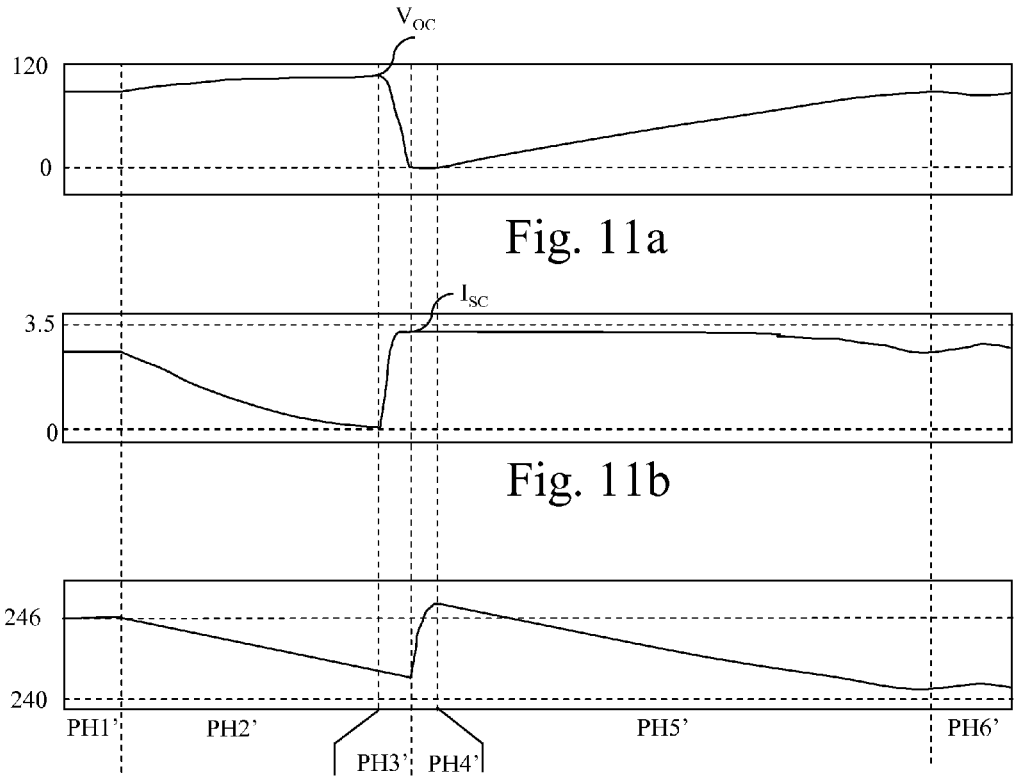
Fig. 11a
Fig. 11b
Fig. 11c

METHOD FOR OBTAINING INFORMATION ENABLING THE DETERMINATION OF A CHARACTERISTIC OF A POWER SOURCE

The present invention relates generally to an apparatus for obtaining information enabling the determination of a characteristic like the maximum power point of a power source like a photovoltaic cell or an array of cells or a fuel cell.

A photovoltaic cell directly converts solar energy into electrical energy. The electrical energy produced by the photovoltaic cell can be extracted over time and used in the form of electric power. The direct electric power provided by the photovoltaic cell is provided to conversion devices like DC-DC up/down converter circuits and/or DC/AC inverter circuits.

However, the current-voltage droop characteristics of photovoltaic cells cause the output power to change nonlinearly with the current drawn from photovoltaic cells. The power-voltage curve changes according to climatic variations like light radiation levels and operation temperatures.

The near optimal point at which to operate photovoltaic cells or arrays of cells is at or near the region of the current-voltage curve where power is greatest. This point is denominated as the Maximum Power Point (MPP).

It is important to operate the photovoltaic cells around the MPP to optimize their power generation efficiency.

As the power-voltage curve changes according to climatic variations, the MPP also changes according to climatic variations.

It is then necessary to be able to identify the MPP at any time.

The present invention aims at providing an apparatus which enables to obtain information representative of the output current and voltage variations of the power source, for example an array of photovoltaic cells, in order to determine the MPP.

To that end, the present invention concerns an apparatus for obtaining information enabling the determination of a characteristic like the maximum power point of a power source, characterised in that the apparatus for obtaining information enabling the determination of the characteristic of the power source comprises means for monitoring the voltage on an inductor linked to the power source in order to obtain information enabling the determination of the characteristic of the power source.

The present invention concerns also a method for obtaining information enabling the determination of a characteristic like the maximum power point of a power source that may be connected to a direct current converter, characterised in that the method comprises the step of monitoring the voltage on an inductor linked to the power source in order to obtain information enabling the determination of the characteristic of the power source.

Thus, it is possible to obtain information representative of the output current and voltage variations of the power source, for example, in order to determine the MPP or to determine a fault of the power source or to determine a fill factor of the power source.

According to a particular feature, the inductor is included in the direct current converter.

In most of DC/DC and/or some DC/AC converters, the inductor is already available for conversion purpose. The inductor can also be used for monitoring the voltage and current variations during at least one particular period of time. The monitored voltage and current variations enable the obtaining of information like the wanted voltage-current/voltage-power droop characteristics of the power source at any time. The present invention avoids to add any other extra inductor to the mentioned inductor-based converters.

According to a particular feature, the apparatus comprises means for obtaining the current going through the inductor during the monitoring of the voltage on the inductor.

Thus, it is possible to obtain the voltage-current/voltage-power droop characteristics of the power source, since its output current and voltage are the same flowing through and applied to the inductor.

According to a particular feature, the current going through the inductor is obtained from a current sensor or derived from the voltage values obtained during the monitoring of the voltage on the inductor.

Thus, it is possible to monitor the current even without adding any extra current sensor, reducing the cost of the apparatus.

Furthermore, as the current through an inductor is obtained by its voltage integration if no current sensor is available, noise variation will not disturb the accuracy of the current estimation, contrary to the derivative calculation as it happens for the current calculation on a capacitor, where sophisticated algorithms must be applied to solve the noise problem, leading to a better estimation of the maximum power point.

According to a particular feature, the apparatus comprises means for discharging the energy stored in the inductor prior to monitoring the voltage on the inductor.

Thus, it is possible to guarantee the most suitable initial conditions for the power source characterization: null current and open-circuit voltage on the power source.

According to a particular feature, in a first phase, current is provided to a load through the inductor, the discharge of the energy stored in the inductor is executed in a second phase and the monitoring of the voltage of the inductor is executed in a third phase wherein a first terminal of the power source is linked to a first terminal of the inductor and wherein the second terminal of the inductor is linked to the second terminal of the power source.

Thus, the inductor is connected in parallel with the power source and it is possible to charge the inductor from null current to the power-source short-circuit current, meaning from open-circuit voltage to null voltage. The whole voltage-current/voltage-power droop characteristics of the power source are obtained.

According to a particular feature, the second terminal of the inductor is connected to a load and the energy stored in the inductor prior to monitoring the voltage of the inductor is discharged in the load.

Thus, it is possible to obtain the initial condition of null current through the inductor by connecting the load in parallel with the inductor when the characterization is to be performed.

Furthermore, the energy stored in the inductor prior to monitoring the voltage of the inductor is discharged in the load, instead of dissipating it through a resistor, resulting in a non-dissipative procedure.

According to a particular feature, the apparatus further comprises a capacitor and at least two switches, the second terminal of the power source is connected to a first terminal of a first switch, the second terminal of the first switch is connected to a first terminal of the capacitor, the second terminal of the capacitor is connected to the first terminal of the power source, the first terminal of the power source is linked to the first terminal of the inductor through a second switch and the second switch is open during the second phase.

Thus, even in the presence of a capacitor connected in parallel with the power source, it is possible to connect only the inductor in parallel with the power source when it is necessary to perform the characterization.

According to a particular feature, the first switch is closed during the first phase and opened during the third phase.

Thus, during normal operation of the converter, the capacitor works as an input filter, but during the third phase, the characterization using the inductor, the capacitor is disconnected and does not have any role at that period of time.

According to a particular feature, the apparatus further comprises a third switch which links the second terminal of the inductor to the second terminal of the power source and in that the third switch is closed during the third phase.

Thus, the inductor can be placed in parallel with the power source only during the third phase, when the characterization is to be performed.

According to a particular feature, a capacitor is connected on the terminals of the power source and in that the apparatus comprises means for obtaining the current going through the capacitor during the monitoring of the voltage on the inductor.

Thus, even in the presence of a capacitor always connected in parallel with the power source, it is possible to obtain the power-source output current since it is resulted from the current through the capacitor plus the current flowing through the inductor. An additional switch in series with the capacitor is no longer needed and the cost of the apparatus does not increase.

According to a particular feature, the current going through the inductor is obtained from the voltage values obtained during the monitoring of the voltage on the inductor.

Thus, if a current sensor is not available in series with the inductor, for example for cost down purpose, it is possible to obtain this current by integrating the measured inductor voltage and dividing it by the inductance value.

According to a particular feature, in a first phase, current is provided to a load through the inductor, in a second phase, the capacitor is charged to the open circuit voltage of the power source and the monitoring of the voltage the inductor is executed in a third phase wherein a first terminal of the power source is linked to a first terminal of the inductor and wherein the second terminal of the inductor is linked to the second terminal of the power source.

In the third phase, the capacitor voltage goes from open-circuit voltage to null value, while the output current of the power source goes from null value to the short-circuit current and while the inductor current goes from null current to a maximum current peak, following a sinusoidal trajectory, where this maximum current value is greater than the power-source short-circuit current, resulted from the resonance between both capacitor and inductor.

Through the monitored voltage, it is possible to obtain the capacitor current by the voltage derivation and also the inductor current by the voltage integration, the capacitance and inductance values being needed as well. The power-source output current variation is obtained together with the voltage variation through the knowledge of the current on each of both components.

The present invention concerns also a direct current converter characterised in that it comprises the apparatus for obtaining information enabling the determination of the maximum power point of a power source.

Thus, it is possible to obtain information representative of the output current and voltage variations of the power source, for example, in order to determine the MPP.

Furthermore, in most of DC/DC and/or in some DC/AC converters, the inductor is already available for conversion purpose. The inductor can also be used for monitoring the voltage and current variations during at least one particular period of time. The monitored voltage and current variations enable the obtaining of information like the wanted voltage-current/voltage-power droop characteristics of the power source at any time. The present invention avoids to add any other extra inductor to the mentioned inductor-based converters.

The characteristics of the invention will emerge more clearly from a reading of the following description of an example embodiment, the said description being produced with reference to the accompanying drawings, among which:

Figure 7A:
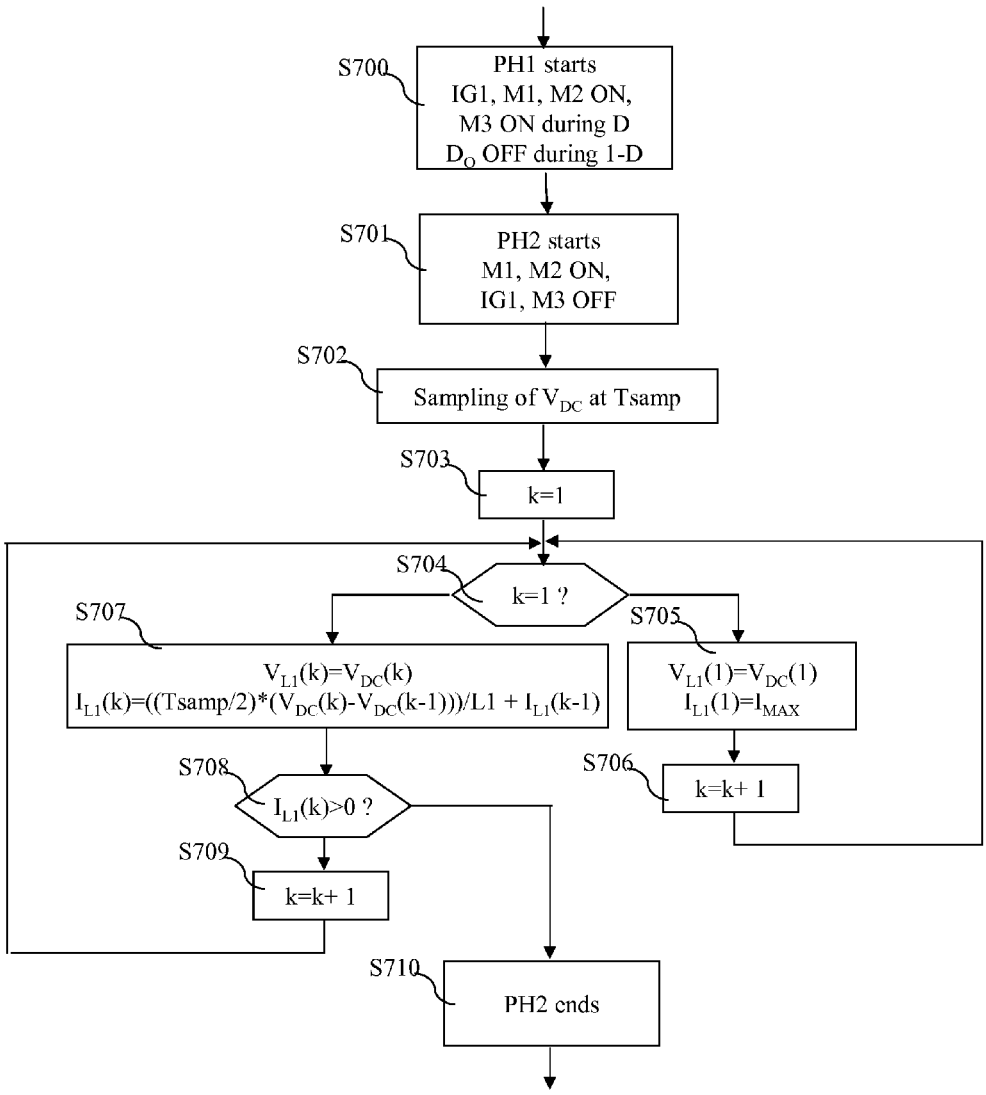
Figure 7B:
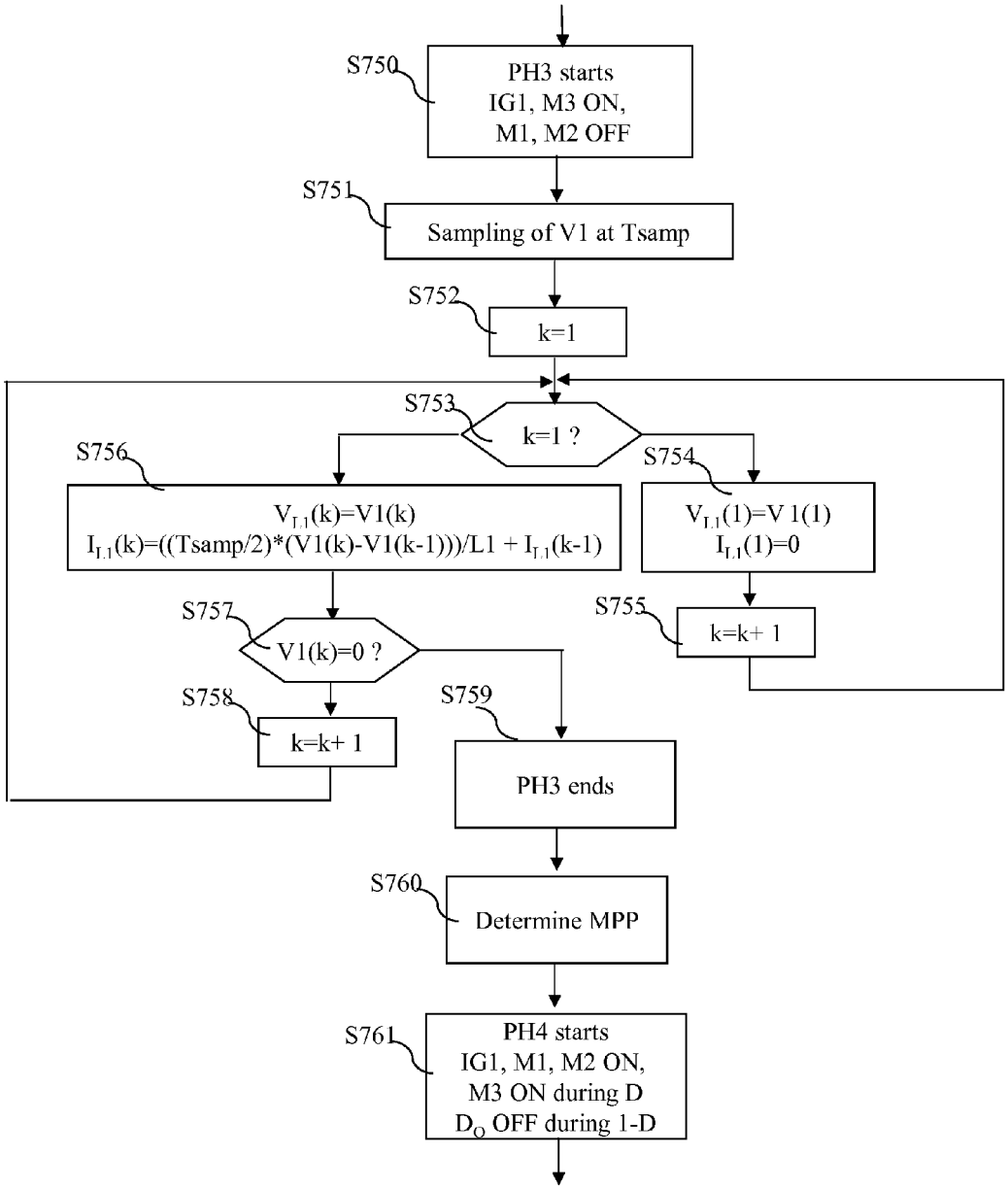
Figures 8A, 8B, 8C, 8D:
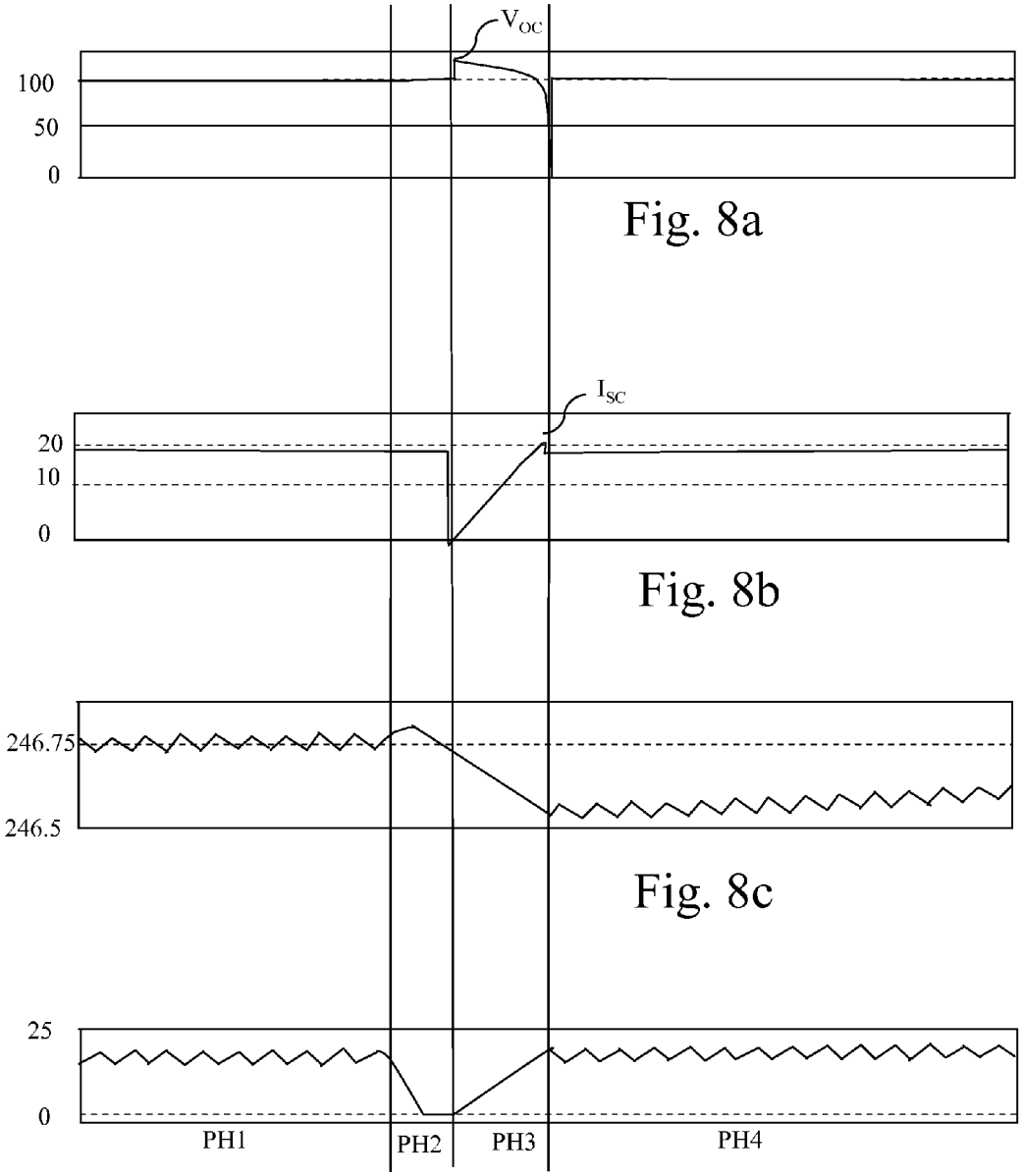
Figure 10:
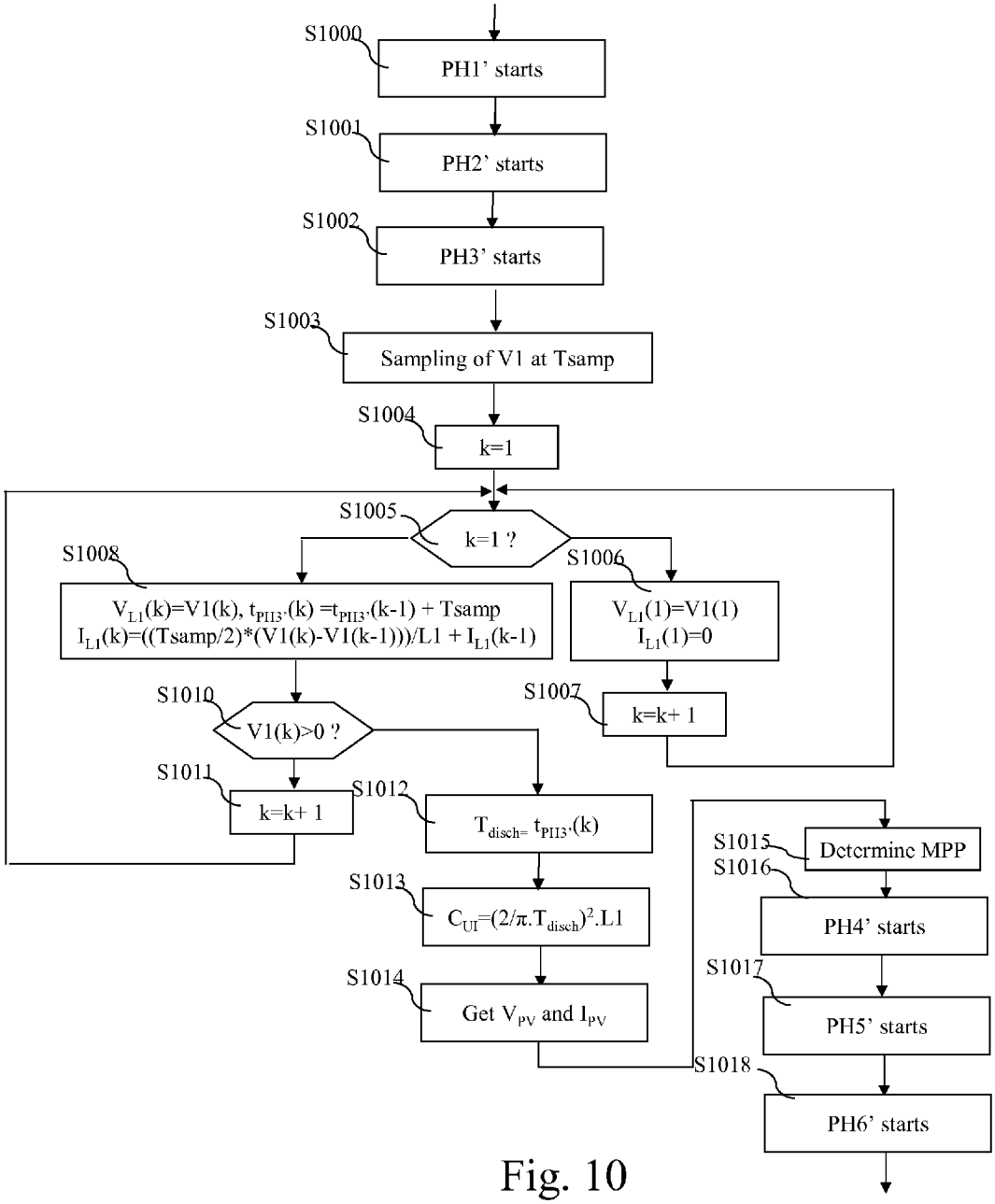
Figure 12:
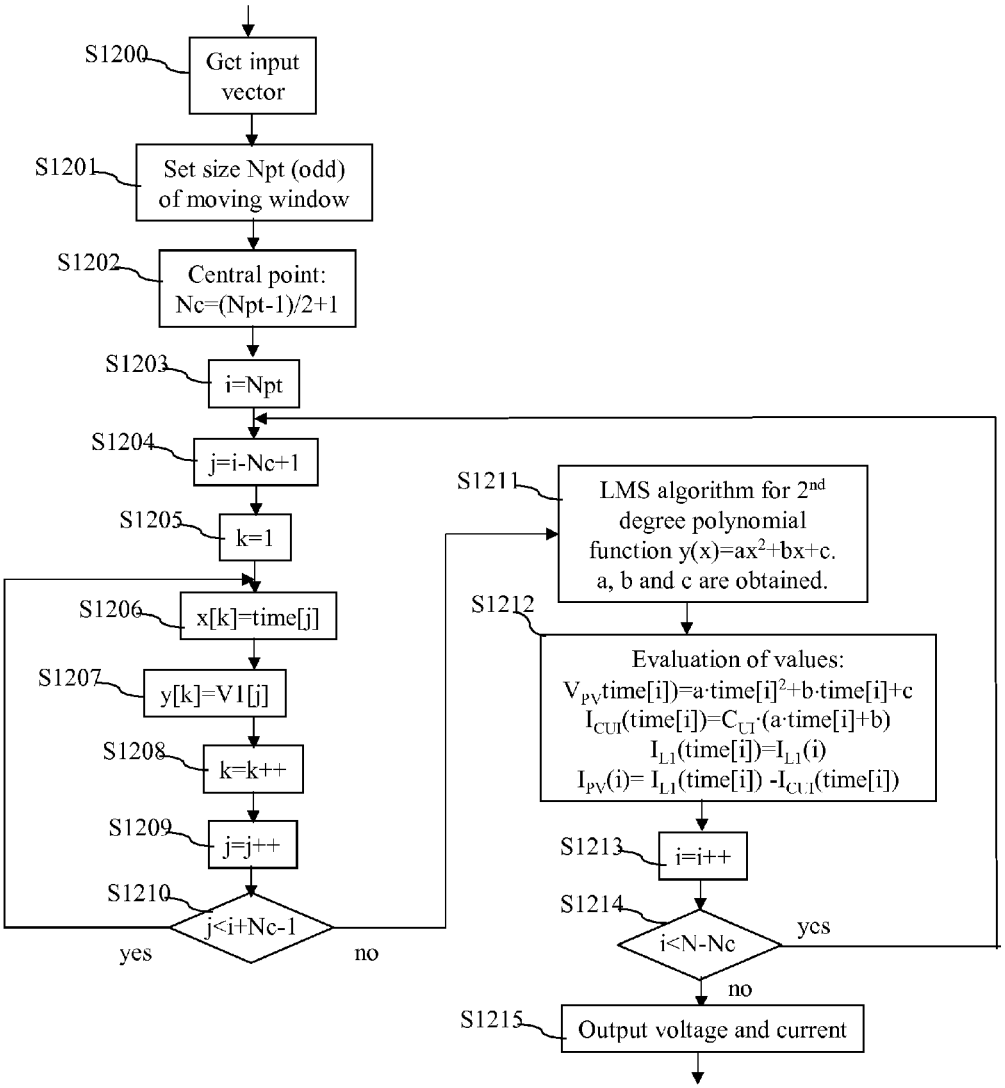
Figure 13A:
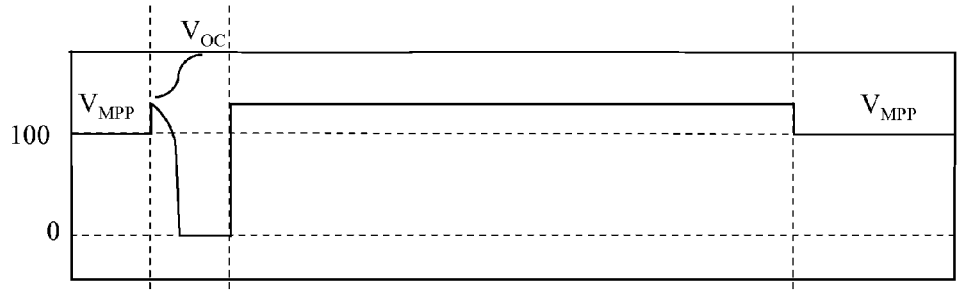
Figure 13B:
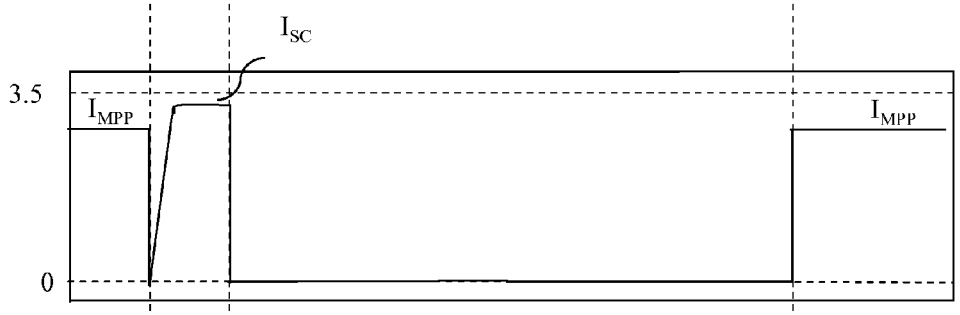
Figure 13C:
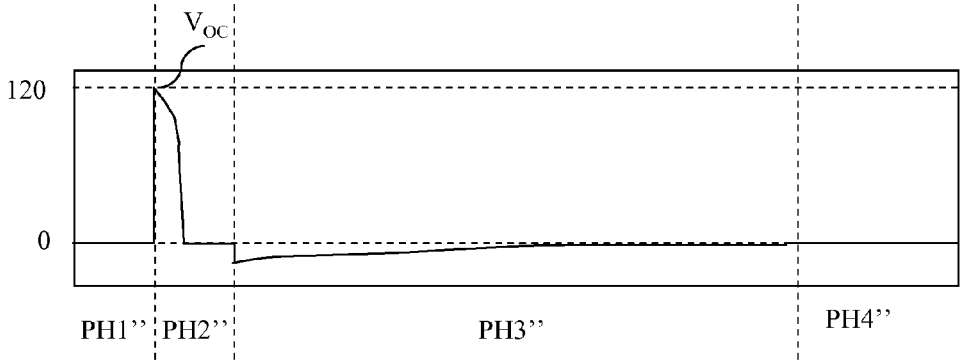

FIGS. 7*a* and 7*b* are examples of algorithms used for determining the maximum power point of the power source according to the second mode of realisation of the present invention;

FIG. 8*a* is an example of the power source voltage variations obtained according to the second mode of realisation of the present invention;

FIG. 8*b* is an example of power source current variations obtained according to the second mode of realisation of the present invention;

FIG. 8*c* is an example of the output voltage variations of the energy conversion device according to the second mode of realisation of the present invention;

FIG. 8*d* is an example of the current variations in the inductor according to the second mode of realisation of the present invention;

FIG. 9 is an example of an electric circuit comprising an inductor according to a third mode of realisation of the present invention in order to obtain information enabling the determination of the maximum power point of the power source;

FIG. 10 is an example of an algorithm for determining the maximum power point of the power source according to the third mode of realisation of the present invention;

FIG. 11*a* is an example of the power source voltage variations obtained according to the third mode of realisation of the present invention;

FIG. 11*b* is an example of power source current variations obtained according to the third mode of realisation of the present invention;

FIG. 11*c* is an example of the output voltage variations of the energy conversion device according to the third mode of realisation of the present invention;

FIG. 12 is an example of an algorithm for determining the output current and output voltage of the power source in order to enable the determination of the maximum power point of the power source according to the third mode of realisation of the present invention;

FIG. 13*a* is an example of the power source voltage variations obtained according to the first mode of realisation of the present invention;

FIG. 13*b* is an example of power source current variations obtained according to the first mode of realisation of the present invention;

FIG. 13*c* is an example of the voltage variations on the inductor according to the first mode of realisation of the present invention.

Figure 1:
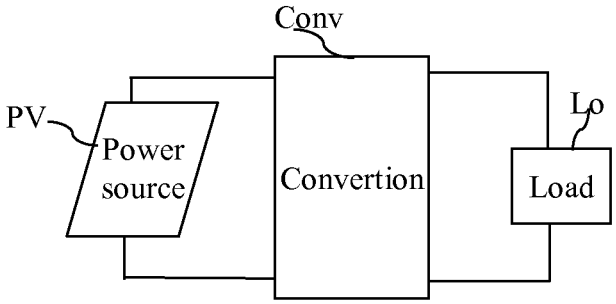
FIG. 1 is an example of an energy conversion system wherein the present invention may be implemented.

FIG. 1 is an example of an energy conversion system wherein the present invention may be implemented.

The energy conversion system is composed of a power source PV like a photovoltaic cell or an array of cells or a fuel cell connected to an energy conversion device Conv like a DC-DC step-down/step-up converter and/or a DC/AC converter also named inverter, which output provides electrical energy to the load Lo.

The power source PV provides current intended to the load Lo. The current is converted by the conversion device Conv prior to be used by the load Lo.

Figure 2:
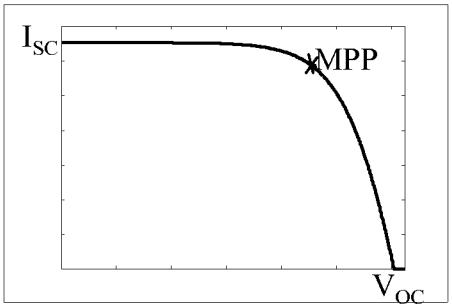
FIG. 2 is an example of a curve representing the output current variations of a power source according to the output voltage of the power source.

FIG. 2 is an example of a curve representing the output current variations of a power source according to the output voltage of the power source.

On the horizontal axis of FIG. 2, voltage values are shown. The voltage values are comprised between null value and the open circuit voltage $V_{OC}$.

On the vertical axis of FIG. 2, current values are shown. The current values are comprised between null value and the short circuit current $I_{SC}$.

At any given light level and photovoltaic array temperature there is an infinite number of current-voltage pairs, or operating points, at which the photovoltaic array can operate. However, there exists a single MPP for a given light level and photovoltaic array temperature.

Figure 3:
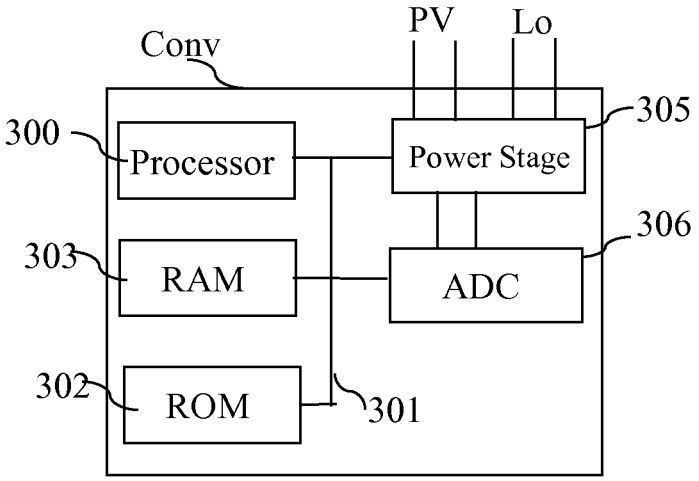
FIG. 3 represents an example of an energy conversion device according to the present invention.

FIG. 3 represents an example of an energy conversion device according to the present invention.

The energy conversion device Conv has, for example, an architecture based on components connected together by a bus 300 and a processor 300 controlled by the programs related to the algorithms as disclosed in the FIG. 7 or 10 and 12.

It has to be noted here that the processor 300 is, in a variant, implemented under the form of one or several dedicated integrated circuits which execute the same operations as the one executed by the processor 300 as disclosed hereinafter.

The bus 301 links the processor 300 to a read only memory ROM 302, a random access memory RAM 303, an analogue to digital converter ADC 306 and the electric circuit according to the invention.

The read only memory ROM 302 contains instructions of the programs related to the algorithms as disclosed in the FIG. 7 or 10 and 12 which are transferred, when the energy conversion device Conv is powered on to the random access memory RAM 303.

The RAM memory 303 contains registers intended to receive variables, and the instructions of the programs related to the algorithms as disclosed in the FIG. 7 or 10 and 12.

The analogue to digital converter 306 is connected to the electric circuit 305 according to the invention which forms the power stage 305 and converts voltages and currents if needed into binary information.

Figure 4:
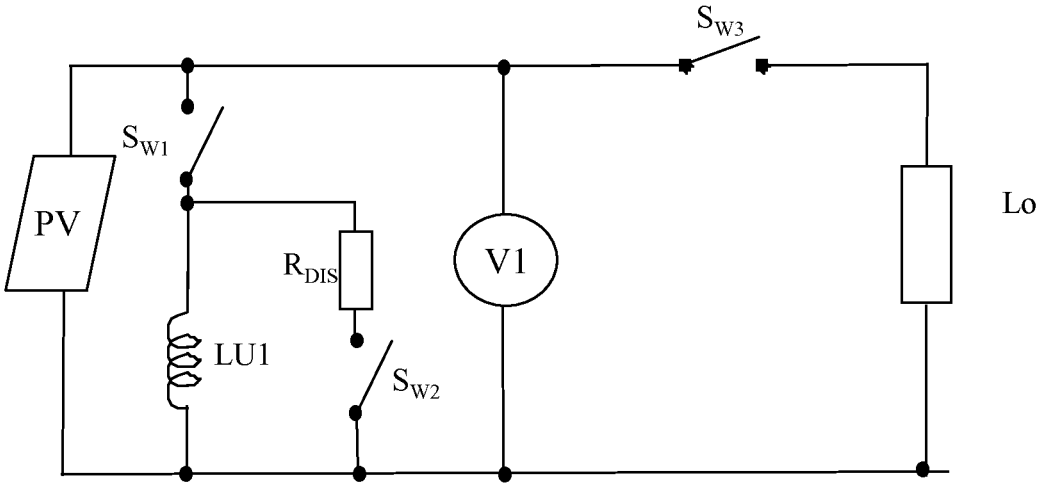
FIG. 4 is an example of an electric circuit comprising an inductor according to a first mode of realisation of the present invention in order to obtain information enabling the determination of the maximum power point of the power source.

FIG. 4 is an example of an electric circuit comprising an inductor according to a first mode of realisation of the present invention in order to obtain information enabling the determination of the maximum power point of the power source.

The electric circuit may be comprised partially or totally in the conversion device Conv or may be added to the conversion device Conv.

The positive terminal of the power source PV is connected to the first terminal of a switch $S_{W1}$ and to the first terminal of a switch $S_{W3}$.

For example, the switches $S_{W1}$ and $S_{W3}$ are NMOSFETs. The first terminals of the switches $S_{W1}$ and $S_{W3}$ are the drain of the respective NMOSFETs.

The second terminal of the switch $S_{W1}$ is connected to the first terminal of an inductor LU1 and to the first terminal of a resistor $R_{DIS}$.

The second terminal of the switch $S_{W1}$ is the source of the NMOSFET. The second terminal of the resistor $R_{DIS}$ is connected to the first terminal of a switch $S_{W2}$.

For example, the switch $S_{W2}$ is a diode. The first terminal of the switch $S_{W2}$ is the cathode of the diode and the second terminal of the switch $S_{W2}$ is the anode of the diode.

The second terminal of the inductor LU1 and the second terminal of the switch $S_{W2}$ are connected to the negative terminal of the power source PV.

The voltage V1 between the terminals of the power source is monitored. The voltage V1 is for example measured using an analogue to digital converter.

The load is connected between the second terminal of the switch $S_{W3}$ and the negative terminal of the power source PV.

The second terminal of the switch $S_{W3}$ is the source of the NMOSFET.

The load may be a direct current converter.

The electric circuit may operate as follows.

In a first phase PH1' as shown in FIG. 13, the switches $S_{W1}$ and $S_{W2}$ are in non conductive state (OFF) and the switch $S_{W3}$ is always in conductive state (ON).

FIG. 13*a* is an example of the power source voltage variations obtained according to the first mode of realisation of the present invention.

The time is represented on horizontal axis of the FIG. 13*a* and the voltage is represented on the vertical axis of the FIG. 13*a*.

FIG. 13*b* is an example of power source current variations obtained according to the first mode of realisation of the present invention.

The time is represented on horizontal axis of the FIG. 13*b* and the current is represented on the vertical axis of the FIG. 13*b*.

FIG. 13*c* is an example of the voltage variations on the inductor according to the first mode of realisation of the present invention.

The time is represented on horizontal axis of the FIG. 13*c* and the voltage is represented on the vertical axis of the FIG. 13*c*.

In phase PH1", the power source supplies power to the load, which can be a resistive load or a direct current converter, as shown in FIGS. 13*a*, 13*b* and 13*c*.

When it is time to perform the power source characterization, the second phase PH2" starts.

In phase PH2", the switches, $S_{W3}$ and $S_{W2}$ are in non conductive state and the switch $S_{W1}$ is in conductive state. In that configuration, the current goes through the inductor LU1, meaning the output current of power source, increasing from zero to short-circuit current as shown in FIG. 13*b*, while the output voltage of the power source goes from the open-circuit voltage value until the null value as shown in FIGS. 13*a* and 13*c*.

During the third phase PH3", the switch $S_{W1}$ is in non conductive state and $S_{W2}$ is in conductive state. The inductor current goes to null value, following its voltage value which also goes to null value as shown in FIG. 13*c*, since the inductor LU1 is discharged through the resistor $R_{DIS}$, and is now ready for another characterization.

During the fourth phase PH4", $S_{W3}$ can be turned in conductive state again and the power source PV can supply power to the load while the inductor LU1 is kept discharged through $R_{DIS}$. The fourth phase PH4" can also start when the inductor LU1 is discharged, meaning that both actions occur simultaneously: inductor is discharged through the resistor while power source is already supplying power to the load.

During the second phase PH2", the voltage V1 is sampled and integrated, in order to obtain the current through the inductor LU1 assuming that the inductance value is known.

Thus, the whole voltage-current/voltage-power droop characteristics of the power source are obtained.

The first mode of realisation has the merit of taking few time, especially when the fourth phase PH4" starts at the same time than the discharge of the inductor LU1. Furthermore, arrays of photovoltaic cells usually have a wider voltage range than the current range, meaning that the variable (current for an inductor or voltage for a capacitor) slope happens in a much faster way for an inductor than for a capacitor if both components values are in the same range.

Figure 5:
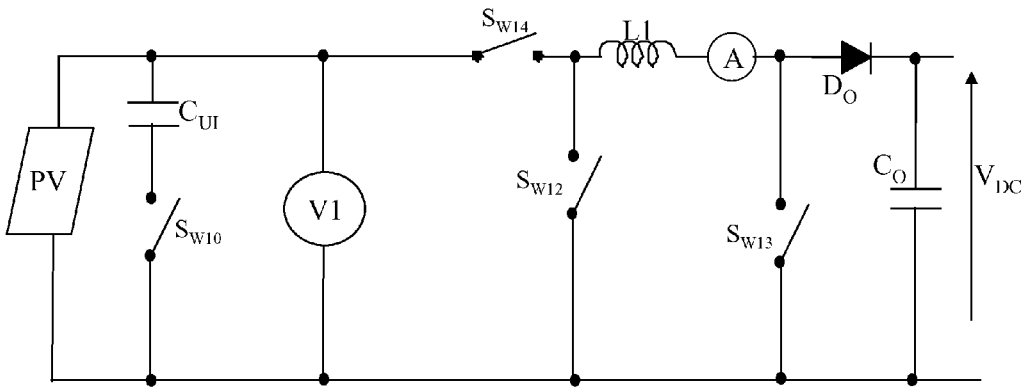
FIG. 5 is an example of an electric circuit comprising an inductor according to a second mode of realisation of the present invention in order to obtain information enabling the determination of the maximum power point of the power source.

FIG. 5 is an example of an electric circuit comprising an inductor according to a second mode of realisation of the present invention in order to obtain information enabling the determination of the maximum power point of the power source.

The electric circuit is a merged buck/boost converter which is able, according to the state of switches, to operate in a buck mode (step-down mode) or in a boost mode (step-up mode), without inverting the output voltage polarity as it is done with the classical buck-boost converter.

The electric circuit according to the second mode of realisation of the present invention comprises an input filter capacitor $C_{UI}$, the positive terminal of which is connected to the positive terminal of the power source PV. The negative terminal of the capacitor $C_{UI}$ is connected to the first terminal of a switch $S_{W10}$, the second terminal of the switch is connected to the negative terminal of the power source PV. Voltage measurement means measure the voltage V1 between the terminals of the power source PV.

The positive terminal of the capacitor $C_{UI}$ is connected to a first terminal of a switch $S_{W14}$.

The second terminal of a switch $S_{W14}$ is connected to a first terminal of a switch $S_{W12}$ and to a first terminal of an inductor L1.

The second terminal of a switch $S_{W12}$ is connected to the negative terminal of the power source PV.

The second terminal of the inductor L1 is connected to a first terminal of current measurement means.

The second terminal of current measurement means A is connected to the anode of a diode $D_O$ and to a first terminal of a switch $S_{W13}$. The second terminal of the switch $S_{W13}$ is connected to the negative terminal of the power source PV.

The cathode of the diode $D_O$ is connected to the positive terminal of a capacitor $C_O$ and the negative terminal of the capacitor $C_O$ is connected to the negative terminal of the power source PV.

When the merged buck/boost converter operates in buck mode, the switch $S_{W13}$ is always in OFF state and diode $D_O$ is always in conductive state.

The switch $S_{W14}$ is in conductive state according to a periodic pattern of which the duty cycle is adjusted in order to get a desired output voltage.

When the merged buck/boost converter operates in boost mode, the switch $S_{W14}$ is always in conductive state and the switch $S_{W12}$ is never in conductive state.

The switch $S_{W13}$ is in conductive state according to a periodic pattern of which the duty cycle is adjusted in order to get a desired output voltage.

Figure 6:
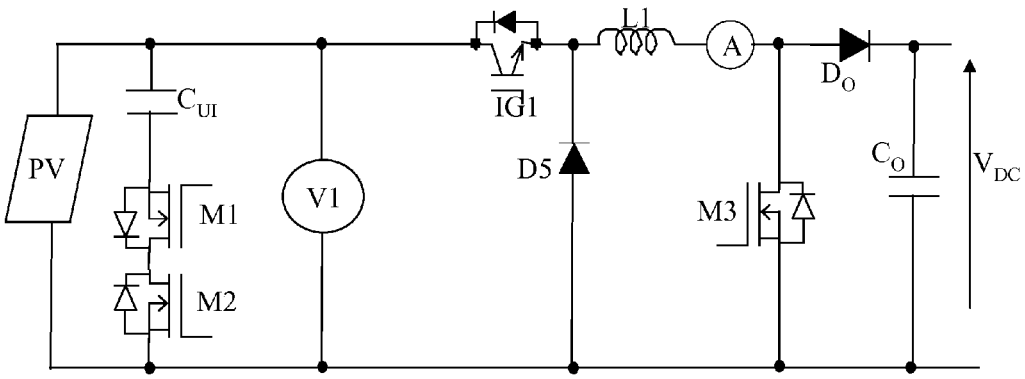
FIG. 6 is an example disclosing a particular mode of realisation of the switches of the electric circuit according to the second mode of realisation of the present invention.

FIG. 6 is an example disclosing a particular mode of realisation of the switches of the electric circuit according to the second mode of realisation of the present invention.

The switch $S_{W10}$ of FIG. 5 is composed of two NMOSFETs M1 and M2.

The first terminal of the switch SW10 is the source of the NMOSFET M1. The second terminal of the switch $S_{W10}$ is the source of the NMOSFET M2. The drain of the NMOSFETs M1 and M2 are connected together.

The switch $S_{W14}$ of FIG. 5 is for example an IGBT transistor IG1. The first terminal of the switch $S_{W14}$ is the collector of the IGBT transistor IG1. The emitter of the IGBT transistor IG1 is the second terminal of the switch $S_{W14}$.

The switch $S_{W12}$ of FIG. 5 is a diode D5. The first terminal of the switch $S_{W12}$ is the cathode of the diode D5 and the second terminal of the switch $S_{W12}$ is the anode of the diode D5.

The switch $S_{W13}$ of FIG. 5 is a NMOSFET M3. The first terminal of the switch $S_{W13}$ is the drain of the NMOSFET M3. The second terminal of the switch $S_{W13}$ is the source of the NMOSFET M3.

FIGS. 7*a* and 7*b* are an example of an algorithm for determining the maximum power point of the power source according to the second mode of realisation of the present invention.

More precisely, the present algorithm is executed by the processor 300.

The algorithm for obtaining information enabling the determination of the maximum power point of the power source monitors at least the voltage on the inductor L1 in a particular phase in order to obtain information enabling the determination of the maximum power point of the power source.

At step S700, the phase PH1 starts. The phase PH1 is shown in the FIGS. 8*a* to 8*d*.

FIG. 8*a* is an example of the power source voltage variations obtained according to the second mode of realisation of the present invention.

The time is represented on horizontal axis of the FIG. 8*a* and the voltage is represented on the vertical axis of the FIG. 8*a*.

FIG. 8*b* is an example of power source current variations obtained according to the second mode of realisation of the present invention.

The time is represented on horizontal axis of the FIG. 8*b* and the current is represented on the vertical axis of the FIG. 8*b*.

FIG. 8*c* is an example of the output voltage variations of the energy conversion device according to the second mode of realisation of the present invention.

The time is represented on horizontal axis of the FIG. 8*c* and the voltage is represented on the vertical axis of the FIG. 8*c*.

FIG. 8*d* is an example of the current variations in the inductor according to the second mode of realisation of the present invention.

The time is represented on horizontal axis of the FIG. 8*d* and the current is represented on the vertical axis of the FIG. 8*d*.

During the phase PH1, the energy conversion device acts, for example, as a boost converter. It has to be noted here that the energy conversion device may act as a buck converter as well.

The NMOSFET M3 and the diode $D_O$ are put in a conductive state and non conductive state according to a periodic pattern of which the duty cycle is adjusted in order to get a desired output voltage. The period of time wherein the command signal of the NMOSFET M3 is high is named D. The period of time wherein the command signal of the NMOSFET M3 is low is named (1−D).

During the phase PH1, the IGBT transistor IG1 is always in conductive state, the NMOSFET M3 is in conductive state during D and in non conductive state during (1−D), the diode $D_O$ is in non conductive state during D and in conductive state during (1−D) and the NMOSFETs M1 and M2 are always in conductive state. The diode D5 is never in conductive state because the converter is operating in boost mode.

The voltage provided by the power source PV shown in FIG. 8*a* during the phase PH1 corresponds to a voltage which corresponds to the MPP previously determined by the present algorithm.

The current provided by the power source PV shown in FIG. 8*b* during the phase PH1 corresponds to a current which corresponds to the MPP previously determined by the present algorithm.

The voltage $V_{DC}$ at the output shown in FIG. 8*c* during the phase PH1 is a regulated voltage obtained from the power source PV output voltage and the duty cycle.

Current is provided to the load during phase PH1.

At next step, S701, the processor 300 decides to interrupt the boost conversion mode in order to determine one more time the MPP and it moves to the phase PH2.

In phase PH2, the NMOSFETs M1 and M2, the diodes D5 and $D_O$ are conductive.

The IGBT transistor IG1 and the NMOSFET M3 are set in non conductive state.

The energy stored in the inductor L1 is transferred to the load and to the capacitor $C_O$. The current going through the inductor L1 drops to null value as shown in FIG. 8*d*, and the output voltage $V_{DC}$ first increases until the said moment in which the inductor current reaches the null value and then decreases, as shown in FIG. 8*c*, since the capacitor $C_O$ starts to discharge in the load when all the energy stored in the inductor was already given to the capacitor $C_O$ and the load.

Simultaneously, the capacitor $C_{UI}$ is slightly charged by the power source as shown in FIGS. 8*a* and 8*b*.

At next step S702, the processor 300 commands the sampling, at the sampling period Tsamp, of the output voltage $V_{DC}$ which corresponds, in the phase PH2 to the voltage on the inductor L1.

At next step S703, the processor 300 sets the variable k to the value one. The variable k is the index used for the samples.

At next step S704, the processor 300 checks if the variable k is equal to one.

If the variable k is equal to one, the processor 300 moves to step S705. Otherwise, the processor 300 moves to step S707.

At step S705, the processor 300 sets the variable $V_{L1}(1)$ at the sampled voltage value $V_{DC}(1)$.

According to a particular mode of realisation, the electric circuit does not comprise current measurement means A. The processor 300 evaluates from the measured voltage value and the inductor L1 value, previously known, the current $I_{L1}$ going through the inductor L1.

According to that mode of realisation, the processor 300 sets the variable $I_{L1}(1)$ at the value $I_{MAX}$, which is equal to the maximum current value for which the inductor L1 was dimensioned.

At next step S706, the processor 300 increments the variable k by one and returns to step S704.

At step S707, the processor 300 sets the variable $V_{L1}(k)$ at the sampled voltage value $V_{DC}(k)$.

If the electric circuit does not comprise current measurement means A, the processor 300 derives the value of the current $I_{L1}(k)$ going through the inductor L1 according to the following formula:

$$I_{L1}(k)=((Tsamp/2)*(V_{DC}(k)-V_{DC}(k-1)))/L1+I_{L1}(k-1).$$

At next step S708, the processor 300 checks if the current value $I_{L1}(k)$ measured by the current measurement means A or determined at step S707 is greater than a predetermined value, for example equal to null value. It has to be noted here that if current measurement means A are not available, at step S707 the predetermined value is set to null value.

If the current value $I_{L1}(k)$ is greater than null value, the inductor L1 is not completely discharged, the processor 300 moves to step S709. Otherwise, the processor 300 moves to step S710.

At step S709, the processor 300 increments the variable k by one and returns to step S704.

At step S710, the processor 300 interrupts the phase PH2.

After that, the processor 300 moves to step S750 of FIG. 7*b*.

At step S750, the processor 300 moves to phase PH3 in order to determine the MPP.

In phase PH3, the NMOSFETs M1, M2, the diodes D5 and $D_O$ are in non conductive state.

In phase PH3, the IGBT transistor IG1 and the NMOSFET M3 are set in conductive state. In phase PH3, the power source PV is connected in parallel with the inductor L1.

In phase PH3, the capacitor $C_{UI}$ is kept charged around the previously determined MPP and the voltage on the power source PV changes to the open circuit voltage $V_{OC}$ as shown in FIG. 8*a*. The inductor L1 is charged from the predetermined value which is for example null value as indicated in step S708 of FIG. 7*a* until the short-circuit current $I_{SC}$ is reached as shown in FIG. 8*b*.

At next step S751, the processor 300 commands the sampling, at the sampling period Tsamp, of the voltage V1 shown in FIG. 6 which corresponds, in the phase PH3, to the voltage on the inductor L1 and also to the power source PV output voltage.

At next step S752, the processor 300 sets the variable k to the value one. The variable k is the index used for the samples.

At next step S753, the processor 300 checks if the variable k is equal to one.

If the variable k is equal to one, the processor 300 moves to step S754. Otherwise, the processor 300 moves to step S756.

At step S754, the processor 300 sets the variable $V_{L1}(1)$ at the sampled voltage value V1(1).

According to a particular mode of realisation, the electric circuit does not comprise current measurement means A. The processor 300 derives from the measured voltage value and the inductor L1 value, the current $I_{L1}$ going through the inductor L1.

According to that mode of realisation, the processor 300 sets the variable $I_{L1}(1)$ to the null value.

At step S755, the processor 300 increments the variable k by one and returns to step S753.

At step S756, the processor 300 sets the variable $V_{L1}(k)$ at the sampled voltage value V1(k).

If the electric circuit does not comprise current measurement means A, the processor 300 obtains the value of the current $I_{L1}(k)$ going through the inductor L1 according to the following formula:

$$L_{L1}(k)=((Tsamp/2)*(V1(k)-V1(k-1)))/L1+I_{L1}(k-1).$$

At next step S757, the processor 300 checks if the voltage value $V_{L1}(k)$ is equal to a predetermined value, for example equal to null value.

If the voltage value $V_{L1}(k)$ is equal to null value, the processor 300 moves to step S759. Otherwise, the processor 300 moves to step S758.

At step S758, the processor 300 increments the variable k by one and returns to step S753.

At step S759, the processor 300 interrupts the phase PH3.

At step S760, the processor 300 gets all the voltage and current values determined at the previous steps and forms a curve as the one shown in FIG. 2.

At the same step, the processor 300 determines the MPP thanks to the voltage and current values obtained at step S756 by selecting the maximum power obtained from voltage and current values.

At step S761, the phase PH4 starts. The phase PH4 is shown in the FIGS. 8*a* to 8*d*.

During the phase PH4, the energy conversion device acts as a boost converter. The NMOSFET M3 and the diode $D_O$ are put in a conductive state and non conductive state according to a periodic pattern of which the duty cycle is adjusted in order to get a desired output voltage considering the newly determined MPP. During the phase PH4, the IGBT transistor IG1 is always in conductive state, the NMOSFET M3 is in conductive state during D, the diode $D_O$ is in conductive state during (1−D) and the NMOSFETs M1 and M2 are always in conductive state.

During the phase PH4, the diode D5 is never in conductive state, the NMOSFET M3 is not in conductive state during (1−D) and the diode $D_O$ is in conductive state during D.

FIG. 9 is an example of an electric circuit comprising an inductor according to a third mode of realisation of the present invention in order to obtain information enabling the determination of the maximum power point of the power source.

The electric circuit is able, according to the state of switches, to operate in a buck mode (step-down mode) or in a boost mode (step-up mode), without inverting the output voltage polarity as it is done with the classical buck-boost converter.

The electric circuit of FIG. 9 is identical to the one disclosed in FIG. 6 except that there are no NMOSFETs M1 and M2.

The filter capacitor $C_{UI}$ is connected to the power source PV and voltage measurement means measure the voltage on the capacitor $C_{UI}$.

FIG. 10 is an example of an algorithm for determining the maximum power point of the power source according to the third mode of realisation of the present invention.

More precisely, the present algorithm is executed by the processor 300.

The algorithm for obtaining information enabling the determination of the maximum power point of the power source monitors the voltage V1 in order to obtain information enabling the determination of the maximum power point of the power source.

At step S1000, the phase PH1' starts. The phase PH1' is shown in the FIGS. 11*a* to 11*c*.

FIG. 11*a* is an example of the voltage variations on the input capacitor $C_{UI}$, meaning the power source voltage variations, obtained according to the third mode of realisation of the present invention.

The time is represented on horizontal axis of the FIG. 11*a* and the voltage is represented on the vertical axis of the FIG. 11*a*.

FIG. 11*b* is an example of power source current variations obtained according to the third mode of realisation of the present invention.

The time is represented on horizontal axis of the FIG. 11*b* and the current is represented on the vertical axis of the FIG. 11*b*.

FIG. 11*c* is an example of the output voltage variations of the energy conversion device according to the third mode of realisation of the present invention.

The time is represented on horizontal axis of the FIG. 11*c* and the voltage is represented on the vertical axis of the FIG. 11*c*.

During the phase PH1', the energy conversion device acts as a boost converter. The NMOSFET M3 and the diode $D_O$ are put in a conductive and non conductive states according to a periodic pattern of which the duty cycle is adjusted in order to get a desired output voltage. The period of time wherein the command signal of the NMOSFET M3 is high is named D. The period of time wherein the command signal of the NMOSFET M3 is low is named (1−D).

During the phase PH1', the IGBT transistor IG1 is always in conductive state, the NMOSFET M3 is in conductive state during D and the diode $D_O$ is in conductive state during (1−D).

During the phase PH1', the diode D5 is never in conductive state, the NMOSFET M3 is not in conductive state during (1−D) and the diode $D_O$ is not in conductive state during D.

The voltage on the capacitor $C_{UI}$ shown in FIG. 11*a* is a voltage which corresponds to the MPP previously determined by the present algorithm.

The current provided by the power source PV shown in FIG. 11*b* is a current corresponding to the MPP previously determined by the present algorithm.

The voltage $V_{DC}$ at the output shown in FIG. 11*c* is a regulated voltage obtained from the power source PV output voltage and the applied duty cycle.

At next step, S1001, the processor 300 decides to interrupt the boost conversion mode in order to determine again the MPP and moves to a phase PH2'.

In phase PH2', the diodes D5 and $D_O$ are in conductive state and the IGBT transistor IG1 and the NMOSFET M3 are set in non conductive state.

The purpose of the phase PH2' is to charge the capacitor $C_{UI}$ up to the open circuit voltage $V_{OC}$ of the power source PV and to completely discharge the inductor L1.

In phase PH2', the energy stored in the inductor L1 is transferred to the load and capacitor $C_O$. Once the current outputted by L1 becomes null, the capacitor $C_O$ supplies energy to the load and $V_{DC}$ decreases as shown in FIG. 11*c*.

The capacitor $C_{UI}$ is charged to the open circuit voltage $V_{OC}$ of the power source PV as shown in FIG. 11*a*.

The current provided by the power source PV reaches null value at the end of the phase PH2'.

At next step S1002, the processor 300 moves to phase PH3'.

In phase PH3', the IGBT transistor IG1 and the NMOSFET M3 are set in conductive state and the diodes $D_O$ and D5 are not in conductive state. In phase PH3', the power source PV and the capacitor $C_{UI}$ are all both connected in parallel with the inductor L1.

The capacitor $C_{UI}$ is discharged until zero voltage and all its energy is stored into the inductor L1, increasing the inductor L1 current value to $I_{MAX}=V_{OC}\cdot\sqrt{C_{UI}/L1}+I_{SC}$. The voltage V1 on the inductor L1 is sampled and stored in order to be able to calculate the current provided by the power source $I_{PV}=I_{L1}+I_{CUI}$.

It has to be noted here that the size of the buffer used for memorizing the data is for example determined considering that the time duration of PH3' is equal to $T_{PH3'}=\pi/2\cdot\sqrt{1\cdot 1C_{UI}\cdot L1}$. It has to be noted here that in a particular mode of realisation of the present invention, the capacitor value $C_{UI}$ is evaluated during phase PH3' as the time duration $t_{pH3'}$ can be evaluated as it will be disclosed at steps S1012 and S1013 in FIG. 10.

At next step S1003, the processor 300 commands the sampling, at the sampling period Tsamp, of the voltage V1 shown in FIG. 9 which also corresponds, in the phase PH3' to the voltage on the inductor L1.

At next step S1004, the processor 300 sets the variable k to the value one. The variable k is the index used for the samples.

At next step S1005, the processor 300 checks if the variable k is equal to one.

If the variable k is equal to one, the processor 300 moves to step S1006. Otherwise, the processor 300 moves to step S1008.

At step S1006, the processor 300 sets the variable $V_{L1}(1)$ at the sampled voltage value V1(1).

According to a particular mode of realisation, the electric circuit does not comprise current measurement means A. The processor 300 derives from the measured voltage value and the L1 inductance value, the current $I_{L1}$ flowing through the inductor L1.

According to that mode of realisation, the processor 300 sets the variable $I_{L1}(1)$ to the null value.

At next step S1007, the processor 300 increments the variable k by one and returns to step S1005.

At step S1008, the processor 300 sets the variable $V_{L1}(k)$ at the sampled voltage value V1(k) and updates the time $t_{pH3'}(k)=t_{pH3'}(k-1)+Tsamp$.

If the electric circuit does not comprise current measurement means A, the processor 300 obtains the value of the current $I_{L1}(k)$ going through the inductor L1 according to the following formula:

$$I_{L1}(k)=((Tsamp/2)*(V1(k)-V1(k-1)))/L1+I_{L1}(k-1).$$

At next step S1010, the processor 300 checks if the voltage value $V_{L1}(k)$ is equal to a predetermined value, for example equal to null value.

If the voltage value $V_{L1}(k)$ is equal to null value, the processor 300 moves to step S1012. Otherwise, the processor 300 moves to step S1011.

At step S1011, the processor 300 increments the variable k by one and returns to step S1005.

At step 1012, the processor 300 determines the duration of the capacitor $C_{UI}$ discharge: $T_{disch}=t_{pH3'}(k)$.

At next step S1013, the processor 300 determines, according to a particular mode of realisation of the present invention the capacitor value $C_{UI}=(2\pi T_{disch})^2\cdot L1$.

At next step S1014 the processor 300 determines each couple of the power source current $I_{PV}$ and power source voltage $V_{PV}$ according to the algorithm which will be disclosed in reference to the FIG. 12.

At next step S1015, the processor 300 gets all the voltage and current values determined at the previous steps and forms a curve as the one shown in FIG. 2. At the same step, the processor 300 determines the MPP thanks to the voltage and current values obtained at step S1215 by selecting the maximum power obtained from voltage and current pairs values.

At next step S1016, the processor 300 moves to the phase PH4'.

In phase PH4', the IGBT transistor IG1 is kept in conductive state and the diodes $D_O$ and D5 are naturally in conductive state. In phase PH4', the NMOSFET M3 is set in a non conductive state.

In phase PH4', the capacitor $C_{UI}$ is maintained uncharged as the IGBT transistors IG1 and D5 are both in conductive state. The inductor L1 is discharged to the capacitor $C_O$ and to the load. The output voltage $V_{DC}$ increases during phase PH4'. The phase PH4' lasts until the moment in which the current through the inductor becomes equal to the short-circuit current $I_{SC}$ and capacitor $C_{UI}$ will start to charge.

At next step S1017, the processor 300 moves to the phase PH5'.

During the phase PH5', the energy conversion device acts as a boost converter. The NMOSFET M3 and the diode $D_O$ are put in a conductive state and non conductive state according to a periodic pattern of which the duty cycle is adjusted in order to get a desired output voltage.

During the phase PH5', the IGBT transistor IG1 is in conductive state, the NMOSFET M3 is in conductive state during D and the diode $D_O$ is conductive during (1−D).

During the phase PH5', the diode D5 is not in conductive state, the NMOSFET M3 is not in conductive state during (1−D) and the diode $D_O$ is not in conductive state during D.

The voltage on the capacitor $C_{UI}$ shown in FIG. 11*a* is a voltage which corresponds to the power source voltage increasing towards the MPP determined by the present algorithm at step 1015.

The current provided by the power source PV shown in FIG. 11*b* is a current which decreases from the short-circuit value towards the current value which corresponds to the MPP value determined at step S1015 by the present algorithm.

The output voltage shown in FIG. 11*c* corresponds to the moving from the capacitor $C_O$ voltage at stage PH4' to the new output voltage value determined according to the MPP determined at step S1015 by the present algorithm and according to a new duty cycle. However, since $C_O$ needs to keep supplying power to the load, there will be an initial decrease on the output voltage value due to the smaller power supplied by the power source during the beginning of PH5', meaning until the moment in which the converter is operative at the MPP i.e. at phase PH6'.

At next step S1018, the processor 300 moves to the phase PH6'.

During the phase PH6', the energy conversion device acts as a boost converter as in the previous phase PH5', with the difference that power source is now supplying the available maximum power (operating at MPP).

FIG. 12 is an example of an algorithm for determining the output power current and output voltage pairs of the power source in order to enable the determination of the maximum power point of the power source according to the third mode of realisation of the present invention.

More precisely, the present algorithm is executed by the processor 300.

The algorithm for obtaining information enabling the determination of the maximum power point of the power source according to the particular mode of realisation of the present invention also uses the voltage V1 in order to determine the current going through the capacitor $C_{UI}$, and consequently the output current of the power source PV, since the inductor current is already known.

From a general point of view, with the present algorithm, the capacitor current for the given sample is determined by multiplying the capacitance value of the capacitor $C_{UI}$ by the voltage derivative of the given sample, the voltage derivative being obtained through a fitted mathematical function, for example a polynomial function with real coefficients.

The fitted mathematical function is obtained by minimizing the sum of the squares of the difference between the measured voltage $y_i$ with i=1 to N at consecutive time samples $x_i$ and mathematical functions $f(x_i)$ in order to obtain a processed voltage for the given time sample. It is done as follows.

Given N samples $(x_1,y_1),(x_2,y_2) \ldots (x_N,y_N)$, the required fitted mathematical function can be written, for example, in the form:

$$f(x)=C_1f_1(x)+C_2f_2(x)+\ldots+C_Kf_K(x)$$

where $f_j(x)$, j=1, 2 . . . K are mathematical functions of x and the $C_j$, j=1, 2 . . . K are constants which are initially unknown.

The sum of the squares of the difference between f(x) and the actual values of y is given by $$E=\sum_{i=1}^{N}[f(x_i)-y_i]^2=\sum_{i=1}^{N}[C_1f_1(x_i)+C_2f_2(x_i)+\ldots+C_Kf_K(x_i)-y_i]^2$$

This error term is minimized by taking the partial first derivative of E with respect to each of constants, $C_j$, j=1, 2, . . . K and putting the result to zero. Thus, a symmetric system of K linear equation is obtained and solved for $C_1$, $C_2$, . . . , $C_K$. This procedure is also known as Least Mean Squares (LMS) algorithm.

Information enabling the determination of the maximum power point are the power-voltage droop characteristics of the power source PV, directly obtained from the current-voltage droop characteristics.

With the voltage samples of V1, a curve is obtained based on the fitting of suitable mathematical functions, for example polynomial functions with real coefficients, in pre-defined windows which will move for each sample. Thus, the voltage is filtered and its derivative can be simultaneously calculated for every central point in the window in a very simple and direct way, resulting in the determination of current without the need of any additional current sensor.

At next step S1200, the processor 300 gets the samples $V_{L1}(k)$ and $t_{PH3'}(k)$ with k=1 to the maximum value taken by k at step S1011 which are obtained at step S1008 during the time period PH3. Each sample is bi-dimensional vector, the coefficients of which are the voltage value and time to which voltage has been measured.

At next step S1201, the processor 300 determines the size of a moving window. The size of the moving window indicates the number Npt of samples to be used for determining a curve based on the fitting of suitable mathematical functions, for example polynomial functions with real coefficients. The size of the moving window is odd. For example, the size of the moving window is equal to seventy one.

At next step S1202, the processor 300 determines the central point Nc of the moving window.

At next step S1203, the processor 300 sets the variable i to the value Npt.

At next step S1204, the processor 300 sets the variable j to i−Nc+1.

At next step S1205, the processor 300 sets the variable k to one.

At next step S1206, the processor 300 sets the value of x(k) to the time coefficient of sample j.

At next step S1207, the processor 300 sets the value of y(k) to the voltage coefficient of sample j.

At next step S1208, the processor 300 increments the variable k by one.

At next step S1210, the processor 300 increments the variable j by one.

At next step S1210, the processor 300 checks if the variable j is strictly lower than the sum of i and Nc minored by one.

If the variable j is strictly lower than the sum of i and Nc minored by one, the processor 300 returns to step S1206. Otherwise, the processor 300 moves to step S1211.

At step S1211, the processor 300 determines the fitted mathematical function, for example the polynomial function $y(x)=ax^2+bx+c$, using the Least Mean Square algorithm and all the x(k) and y(k) values sampled at steps 1206 and 1207 until the condition on S1210 is reached.

The processor 300 obtains then the a, b and c real coefficients of the second degree polynomial function ($[a,b,c]\in\mathfrak{R}^3$).

At next step S1212, the processor 300 evaluates the filtered voltage value and the needed currents according to the following formulas:

$$V_{PV}(\text{time}[i])=a\cdot\text{time}[i]^2+b\cdot\text{time}[i]+c$$

$$I_{CUI}(\text{time}[i])=C_{UI}\cdot(a\cdot\text{time}[i]+b)$$

$$I_{L1}(\text{time}[i])=I_{L1}[i]$$

$$I_{PV}=I_{L1}(\text{time}[i])+I_{CUI}(\text{time}[i])$$

At next step S1213, the processor 300 increments the variable i by one unit.

At next step S1214, the processor 300 checks if i is strictly lower than N minored by Nc wherein N is the total number of voltage samples obtained at step S701.

If i is strictly lower than N minored by Nc, the processor 300 returns to step S1204. Otherwise, the processor 300 moves to step S1215 and outputs voltage and current pairs determined by the present algorithm.

After that, the processor 300 interrupts the present algorithm and returns to step S1015 of the algorithm of FIG. 10.

Naturally, many modifications can be made to the embodiments of the invention described above without departing from the scope of the present invention.

The invention claimed is:

1. An apparatus for obtaining information enabling a determination of a maximum power point of a power source, comprising:

means for discharging energy stored in an inductor linked to the power source;

means for monitoring voltage values on the inductor linked to the power source only after the discharging of the energy stored in the inductor by the means for discharging in order to obtain discharged inductor voltage information enabling the determination of the maximum power point of the power source; and means for obtaining a value of a current going through the inductor during the monitoring of the voltage values on the inductor.

2. The apparatus according to claim 1, wherein the inductor is included in a direct current converter.

3. The apparatus according to claim 2, wherein the means for obtaining the value of the current going through the inductor during the monitoring of the voltage values on the inductor obtains the value of the current by derivation from the monitored voltage values.

4. The apparatus according to claim 1, wherein in a first phase, current is provided to a load through the inductor, the discharge of the energy stored in the inductor by the means for discharging the energy stored in the inductor is executed in a second phase and the monitoring of the voltage values on the inductor is executed by the means for monitoring in a third phase after the second phase, and wherein a first terminal of the power source is linked to a first terminal of the inductor and wherein a second terminal of the inductor is linked to a second terminal of the power source.

5. The apparatus according to claim 4, wherein the second terminal of the inductor is connected to the load and the energy stored in the inductor prior to monitoring the voltage values on the inductor is discharged in the load by the means for discharging the energy stored in the inductor.

6. The apparatus according to claim 4, wherein the apparatus further comprises a capacitor and at least two switches, the second terminal of the power source is connected to a first terminal of a first switch, a second terminal of the first switch is connected to a first terminal of the capacitor, a second terminal of the capacitor is connected to the first terminal of the power source, the first terminal of the power source is linked to the first terminal of the inductor through a second switch and the second switch is open during the second phase.

7. The apparatus according to claim 6, wherein the first switch is closed during the first phase and opened during the third phase.

8. The apparatus according to claim 6, wherein the apparatus further comprises a third switch which links the second terminal of the inductor to the second terminal of the power source and the third switch is closed during the third phase.

9. The apparatus according to claim 1, wherein a capacitor is connected on the terminals of the power source and the apparatus comprises means for obtaining a value of a current going through the capacitor during the monitoring of the voltage on the inductor.

10. The apparatus according to claim 9, wherein the means for obtaining the value of current going through the inductor is obtained from the voltage values obtained during the monitoring of the voltage values on the inductor by the means for monitoring.

11. The apparatus according to claim 9, wherein in a first phase, current is provided to a load through the inductor, in a second phase the capacitor is charged to an open circuit voltage of the power source and the monitoring of the inductor voltage values is executed in a third phase by the means for monitoring wherein a first terminal of the power source is linked to a first terminal of the inductor and when a second terminal of the inductor is linked to a second terminal of the power source.

12. A direct current converter comprising the apparatus according to claim 1.

13. A method for obtaining information enabling a determination of a maximum power point of a power source connected to a direct current converter, the method comprising:

discharging energy stored in an inductor;

monitoring the voltage values on the inductor linked to the power source only after discharging the energy stored in the inductor in order to obtain discharged inductor voltage information enabling the determination of the maximum power point of the power source; and deriving the current going through the inductor from the voltage values obtained during the monitoring of the voltage values on the inductor.

* * * * *